US005823405A

United States Patent [19]

Benns

[11] Patent Number: 5,823,405

[45] Date of Patent: Oct. 20, 1998

[54] AEROSOL CAP WITH RETAINER FOR SPRAY TUBE

[76] Inventor: Michael J. Benns, 440 - Third Ave. - Suite A, Charleston, W. Va. 25303

[21] Appl. No.: 888,279

[22] Filed: Jul. 3, 1997

[51] Int. Cl.[6] ..... B05B 15/06

[52] U.S. Cl. ..... 222/538

[58] Field of Search ..... 222/182, 192, 222/530, 538, 402.13, 562

[56] References Cited

U.S. PATENT DOCUMENTS

| | | | |
|---|---|---|---|
| 118,154 | 8/1871 | Rogers . | |
| 1,284,822 | 11/1918 | Tumey . | |
| 1,411,573 | 4/1922 | McGarrahan . | |
| 3,318,488 | 5/1967 | Barnes . | |
| 3,372,846 | 3/1968 | Berkus | 222/538 X |
| 3,428,220 | 2/1969 | Osrow . | |
| 3,954,207 | 5/1976 | Gerding et al. | 222/530 X |
| 4,096,974 | 6/1978 | Haber et al. . | |
| 4,413,756 | 11/1983 | Kirley . | |
| 4,520,951 | 6/1985 | Facey . | |
| 4,684,032 | 8/1987 | Tsay . | |
| 5,388,712 | 2/1995 | Brody | 222/538 X |
| 5,411,187 | 5/1995 | Schwab | 222/538 |
| 5,477,993 | 12/1995 | Maeda | 222/402.13 |
| 5,518,143 | 5/1996 | Iodice | 222/530 X |

FOREIGN PATENT DOCUMENTS

| | | | |
|---|---|---|---|
| 893535 | 2/1972 | Canada . | |
| 952070 | 7/1974 | Canada . | |
| 406001382 | 1/1994 | Japan | 222/538 |
| 1154775 | 6/1969 | United Kingdom . | |

*Primary Examiner*—Kevin P. Shaver
*Attorney, Agent, or Firm*—Carmine M. Cuda

[57] ABSTRACT

A cap for an aerosol container comprising an annular wall open at its bottom end and closed at its upper end by a top wall, one of the walls having retaining devices for releasably retaining a tube within said one wall whereby when the tube is releasably retained within the one wall, an aperture surrounds the tube and upon applying a predetermined force to the tube, the retaining devices release the tube so that the tube is capable of being completely removed from the aperture. The cap may include a second aperture spaced from the first mentioned aperture and guiding devices for guiding an advancing end of the tube toward the second aperture.

9 Claims, 3 Drawing Sheets

AEROSOL CAP WITH RETAINER FOR SPRAY TUBE

BACKGROUND OF THE INVENTION

This invention relates, in general, to aerosol caps, and, in particular, to an improved cap for use with a pressurized spray container.

DESCRIPTION OF THE PRIOR ART

In the prior art various types of devices are known for retaining a dispensing tube with a container for aerosol products. Conventional aerosol type spray cans containing lubricating or cleaning fluid are commonly supplied with a small bore dispensing tube for use where precise aiming of the spray is desired. These spray cans include a spray discharge nozzle into which the tube may be inserted for directing the contents to a small area. The discharge nozzle may be used without the tube in order to spray a large area. Rubber bands, tape and clips have been used in the past to retain the tube to the spray can. One of the disadvantages of these devices is the cost of supplying and affixing a separate element to retain the tube. Another disadvantage of these devices is that upon removing the tube from the separate element in order to use the tube with the aerosol valve, the rubber band, tape or clip may become disconnected and lost or may become damaged to the point that reuse is not possible. The rubber bands break from repeated use and from the effects of aging. The tape either tears while removing the tube or get distorted and stuck together in the absence of the tube. It is also known to provide a cap with an integral means for retaining a dispensing tube. For example, U.S. Pat. No. 4,520,951 discloses an aerosol cap having a transverse groove in the top wall. The groove includes protuberances for releasably retaining the tube in the groove. The disadvantage of this type of cap is that the groove is generally U-shaped with a gap opening upwardly. The retained tube may be dislodged and lost upon placing the can and attached cap down into a box or other container since a side wall of the box or container could push the laterally extending tube up and out of the groove.

U.S. Pat. No. 4,096,974 discloses a cover assembly including a rotatable sleeve with a discharge port having a flexible hose attached thereto. While this solves the problem of a lost discharge hose, the cover assembly is complex, uneconomical and requires many parts.

Other aerosol caps with apertures for different purposes are known. For example, U.S. Pat. No. 3,428,220 discloses a pressurized container with a cap having integral suspension means for display purposes. U.S. Pat. No. 3,318,488 discloses a cap with vent notches in the skirt for the passage of air to eliminate rust. U.S. Pat. No. 4,413,756 discloses a cap with holes for venting discharged product.

SUMMARY OF THE INVENTION

The present invention is a cup shaped cap or cover for an aerosol can. The cap includes at least one wall aperture and retaining means arranged to releasably retain an aerosol dispensing tube within the aperture. The dispensing tube is retained such that it projects out through a wall of the cap and is surrounded by the aperture. The cap preferably includes two wall apertures and guiding means for guiding an end of the dispensing tube inserted in a first aperture toward the second aperture.

Preferably, the cap is formed by molding from a suitable plastics material.

It is an object of the present invention to provide an aerosol cap which is simple to make and easy to use.

It is an object of the present invention to provide an aerosol cap having integral devices which are strong, reusable and have a long life for storage of a dispensing tube in a non-use position.

It is an object of the present invention to provide an aerosol cap which prevents loss of a dispensing tube.

These and other objects and advantages of the present invention will be fully apparent from the following description, when taken in connection with the annexed drawings.

BRIEF DESCRIPTION OP THE DRAWINGS

DESCRIPTION OF THE PREFERRED EMBODIMENT

Figure 1:
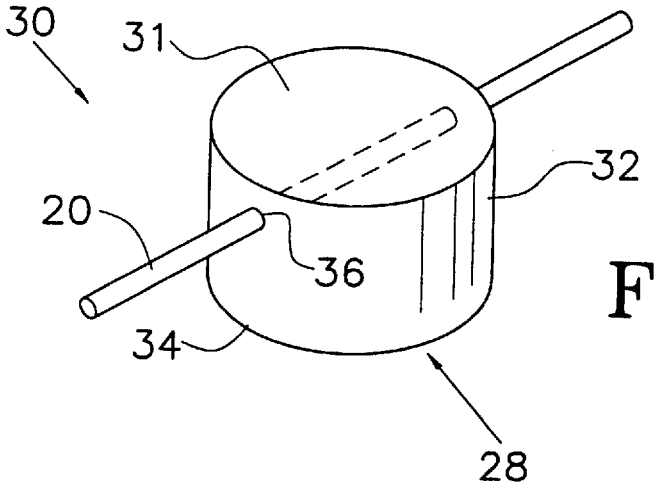
FIG. 1 is a perspective view of an aerosol cap of the present invention.

Referring now to the drawings in greater detail, FIG. 1 shows a perspective view of a basic version of an aerosol cap 30 for use with a pressurized can (not shown). Cap 30 is a generally inverted cup-shaped cover with an open bottom 34, a side wall 32 and a top wall 31. The cap includes first and second apertures 36,38 in the side wall for receiving a tube 20 which is used for dispensing aerosol product in the can. The cap defines an interior chamber 28 for receiving an upper end of the can.

Figure 2:
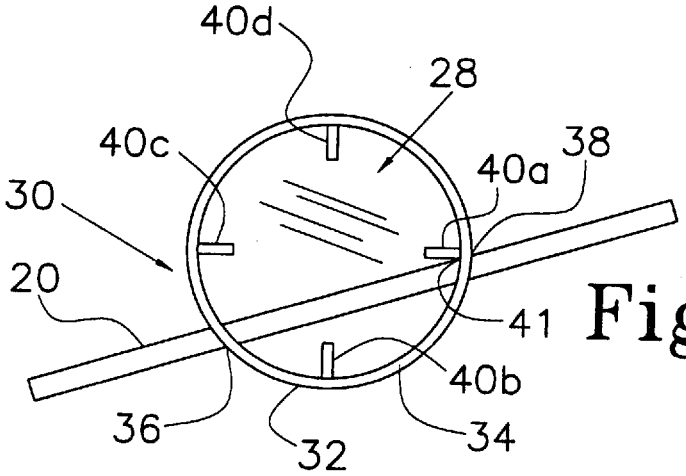
FIG. 2 is a plan view of the bottom of the aerosol cap of the present invention.

FIG. 2 shows a plan view of the bottom of the aerosol cap. Four generally radially extending ribs or walls 40*a*–40*d* are connected to the side wall within the interior chamber of the cap. Rib 40*a* is connected to the side wall closely adjacent the second aperture 38. The location and orientation of this rib 40*a* relative to the apertures 36, 38 defines a guiding means for guiding an end 20*a* of the tube towards the second aperture 38. The juncture of rib 40*a* with the side wall 32 defines an inside corner 41 along which the second aperture 38 is located. When the advancing end 20*a* of the tube contacts rib 40*a*, the end slides along the rib and into the inside corner 41. A mere rocking of the tube 20 will move the advancing end 20*a* along the inside corner 41 and into the second aperture 38.

Figure 3:
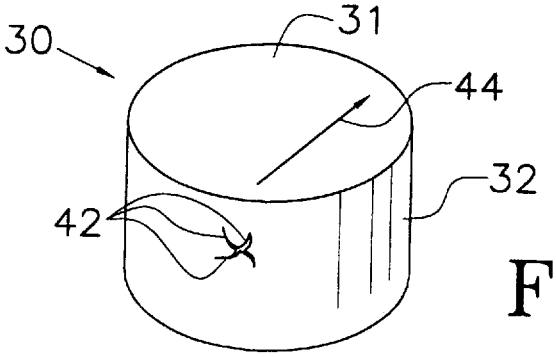
FIG. 3 is a perspective view of another embodiment of the aerosol cap of the present invention.

FIG. 3 shows a perspective view of the aerosol cap with the tube removed and including indicia 44 on the topwall 31. Indicia 44 is optionally used to indicate the preferred direction of tube advancement from the first aperture 36 to the second aperture 38. The first aperture 36 is shown in the form of slots or slits. The plastic cap is pliable and resilient so that upon advancing the tube end into the slits, the aperture 36 opens and releasably retains the tube 20 within the sidewall 32.

Figure 4:
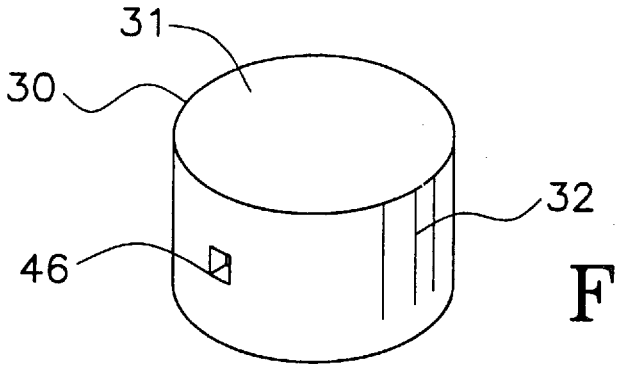
FIG. 4 is a perspective view of a third embodiment of the aerosol cap of the present invention.

FIG. 4 shows a perspective view of the aerosol cap with a modified sidewall. The aperture is formed within a depression or cavity 46 in the sidewall. The cavity includes a flat wall 47 within which the aperture is formed. The flat wall 47 extends in a plane normal to the longitudinal axis of the tube when the tube is within the first and second apertures. Insertion of the tube in the first aperture is thus facilitated especially for a cap having a curved sidewall. Alternatively, the cavity could include converging or funnel-shaped surfaces (not shown) to further facilitate insertion of the tube in the first aperture.

Figure 5:
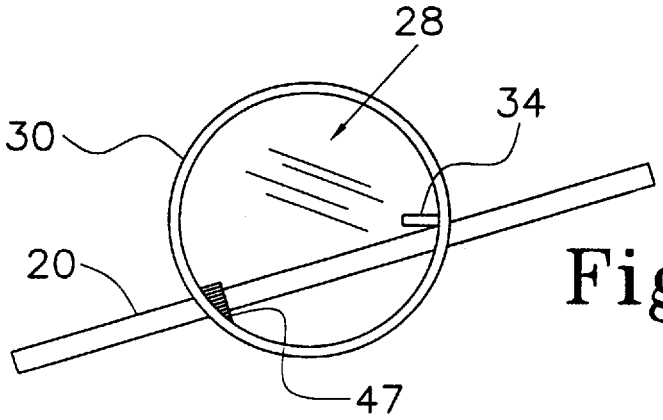
FIG. 5 is a plan view of the bottom of the third embodiment of the aerosol cap of the present invention.

FIG. 5 shows a plan view of the bottom of the aerosol cap of FIG. 4 with a tube inserted to more clearly illustrate the cavity 46 and flat wall 47.

Figure 6:
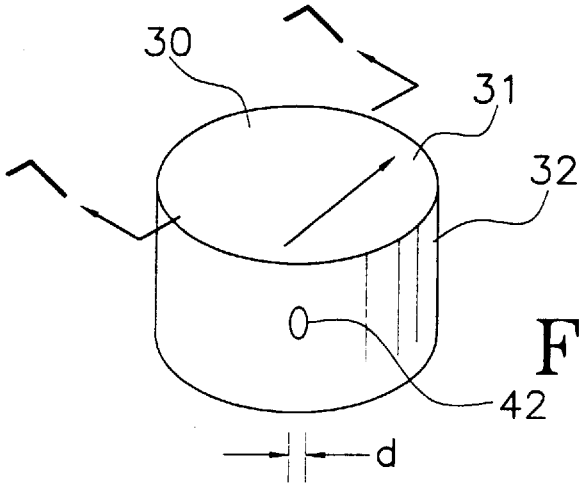
FIG. 6 is a perspective view of a fourth embodiment of the aerosol cap of the present invention.

FIG. 6 shows a perspective view of an aerosol cap with an aperture having a predetermined dimension d which is less than the outside diameter of the tube. Advancing the tube end into this type of aperture opens the aperture and releasably retains the tube within the sidewall.

Figure 7:
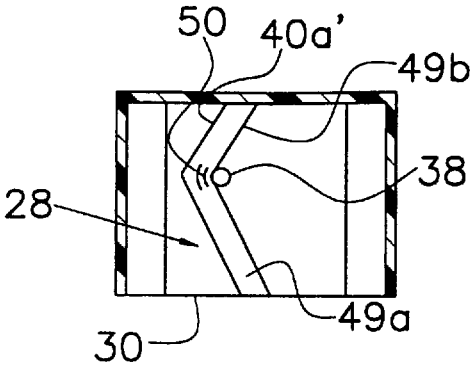
FIG. 7 is a cross-sectional view taken along line 7—7 of FIG. 6.

FIG. 7 shows a cross-sectional view of the aerosol cap of FIG. 6. This cap includes a modified guide rib 40*a*' formed of two wall portions 49*a*, 49*b* angled with respect to each other. The juncture of the angled wall portions forms a valley or channel 50 which guides an advancing end of the tube towards the second aperture.

Figure 8:
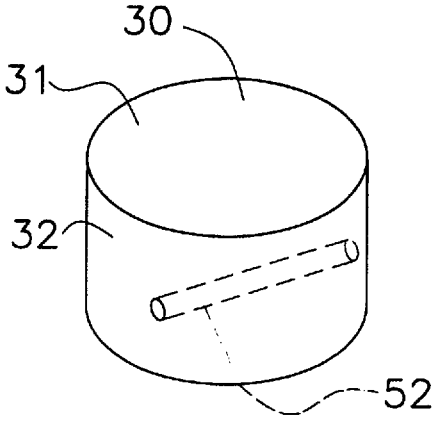
FIG. 8 is a perspective view of a modified embodiment of the aerosol cap of the present invention.

FIG. 8 shows a perspective view of a modified embodiment of the aerosol cap having a tubular conduit 52 which guides an advancing end of the tube towards the second aperture. Preferably the tubular conduit 52 is sized to releasably retain the tube therein. The tubular conduit may include any of the other retaining means disclosed with the present invention.

Figure 9:
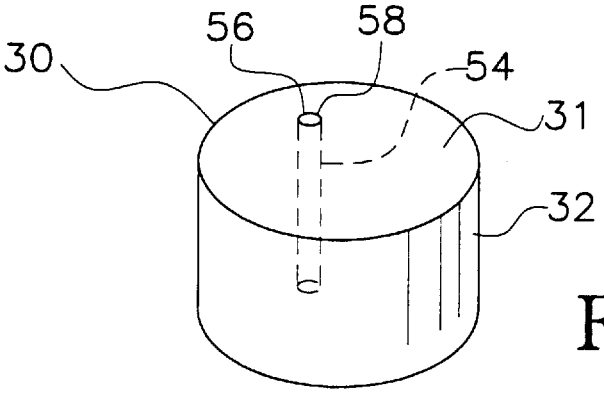
FIG. 9 is a perspective view of another modified embodiment of the aerosol cap of the present invention.

FIG. 9 shows a perspective view of another modified embodiment of the aerosol cap having a tubular portion 54 extending downwardly from the top wall 31. An aperture 56 in the top wall includes means to releasably retain a tube therein in the form of inwardly directed prongs 58.

Although the aerosol cap and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An inverted cup-shaped cover for use with a container having an associated dispensing tube releasably attachable to the pressurized container, said cover comprising:

an interior surface and an exterior surface, said interior surface defining an interior chamber; and a retainer disposed on said interior surface and adapted to releasably retain the dispensing tube in a non-use storage position such that the dispensing tube extends from an exterior of said cover, through a wall of said cover and into said interior chamber, the dispensing tube being released from said retainer for attachment to the container when used to dispense contents from within the container.

2. A cap for use with a container having an associated dispensing tube releasably attachable to aerosol container, said cap comprising:

an annular wall open at a bottom end thereof and closed at an upper end thereof by a top wall;

a retainer for releasably retaining a dispensing tube within at least one of said annular wall and said top wall, said retainer including at least a first aperture defined by said one of said annular wall and said top wall, and a second aperture defined by said one of said annular wall and said top wall, said second aperture being spaced from said first aperture and each of said first and second apertures being adapted to receive the dispensing tube whereby, when the dispensing tube is releasably retained within said retainer, each of said first and second apertures surrounds the dispensing tube and upon applying a predetermined force to the dispensing tube, said retainer releases the dispensing tube so that the dispensing tube is capable of being completely removed from said first and second apertures; and a guide for guiding an advancing end of the dispensing tube toward said second aperture.

3. A cap in accordance with claim 2 wherein said retainer further includes a plurality of prongs defined by at least one of said first aperture and said second aperture.

4. A cap in accordance with claim 2 wherein at least one of said first aperture and said second aperture is smaller in at least one dimension than an outside diameter of the dispensing tube such that inserting the dispensing tube into said at least one of said first aperture and said second aperture causes said at least one of said first aperture and said second aperture to enlarge and to firmly grip the dispensing tube.

5. A cap in accordance with claim 2 wherein said guide includes an inwardly directed wall disposed within said cap.

6. A cap in accordance with claim 5 wherein said inwardly directed wall includes two wall portions angled with respect to each other whereby said guide guides an advancing end directly towards said second aperture.

7. A cap in accordance with claim 2 wherein said guide includes a tubular conduit disposed within said cap.

8. A cap in accordance with claim 2 further including a cavity in said one of said annular wall and said top wall to facilitate insertion of the dispensing tube into said first aperture.

9. A cap in accordance with claim 2 wherein said retainer further includes a tubular portion extending inwardly from said first aperture in a direction toward said second aperture.

* * * * *